US012376683B1

(12) United States Patent
Wang

(10) Patent No.: US 12,376,683 B1
(45) Date of Patent: Aug. 5, 2025

(54) FOLDABLE BRACKET AND CAMPING BED

(71) Applicant: Xiamen Zhengchuangyou Trading Co., Ltd, Xiamen (CN)

(72) Inventor: Li Ii Wang, Xiamen (CN)

(73) Assignee: Xiamen Zhengchuangyou Trading Co., Ltd, Xiamen (CN)

( * ) Notice: Subject to any disclaimer, the term of this patent is extended or adjusted under 35 U.S.C. 154(b) by 0 days.

(21) Appl. No.: 18/935,702

(22) Filed: Nov. 4, 2024

(51) Int. Cl.
*A47C 17/72* (2006.01)
*A47C 17/70* (2006.01)

(52) U.S. Cl.
CPC ..... *A47C 17/70* (2013.01)

(58) Field of Classification Search
CPC ..... A47C 17/70; A47C 17/705; A47C 17/72; A47C 17/74; A47C 17/76; A47C 17/68; A47C 17/64
See application file for complete search history.

(56) References Cited

U.S. PATENT DOCUMENTS 241,210 A * 5/1881 Griffith ..... A47C 19/126 5/116
1,335,456 A * 3/1920 Nelson ..... A47C 17/64 5/113
1,439,272 A * 12/1922 Smith ..... A47C 19/14 5/115
1,518,386 A * 12/1924 Brower ..... A47C 17/72 5/117
2,215,758 A * 9/1940 Knight ..... A47C 17/34 297/115
2,509,544 A * 5/1950 Turner ..... A47C 19/122 211/195
4,783,863 A * 11/1988 Degen ..... A47C 17/84 5/103
4,846,204 A * 7/1989 Sok Kyu ..... E04H 15/50 52/109
6,581,223 B1 * 6/2003 Wang ..... A47C 17/72 5/174
9,756,950 B2 * 9/2017 Choi ..... A47C 19/126
11,700,949 B1 * 7/2023 Zhu ..... A47C 17/72 5/116
2003/0233966 A1 * 12/2003 Zheng ..... A47B 3/02 108/115
2008/0216230 A1 * 9/2008 Yul ..... A47C 17/64 297/16.2

(Continued)

*Primary Examiner* — Justin C Mikowski
*Assistant Examiner* — Ifeolu A Adeboyejo
(74) *Attorney, Agent, or Firm* — Jose Cherson Weissbrot

(57) ABSTRACT

The present invention discloses a foldable bracket, where a first connecting member and a second connecting member are respectively placed at two ends of a retractable rod body; a first support crossbar is rotatably connected to the first connecting member; a first support rod is rotatably connected to a second support rod, and the first support rod is rotatably connected to the first connecting member; the second support rod is rotatably connected to the second connecting member, and the second support rod is rotatably connected to the first support crossbar; a first rod body is rotatably connected to a second rod body, an end of the first rod body away from the second rod body is rotatably connected to the first support crossbar, and an end of the second rod body away from the first rod body is rotatably connected to the second connecting member.

17 Claims, 7 Drawing Sheets

(56) References Cited

U.S. PATENT DOCUMENTS

| | | | | |
|---|---|---|---|---|
| 2009/0139026 | A1* | 6/2009 | Chen | A47C 19/126 5/111 |
| 2009/0249546 | A1* | 10/2009 | Yul | A47C 19/14 5/115 |
| 2012/0047649 | A1* | 3/2012 | Grace | A47C 17/64 5/115 |
| 2015/0282629 | A1* | 10/2015 | Lamke | A47C 17/72 5/111 |
| 2016/0150889 | A1* | 6/2016 | Choi | A47C 19/126 5/111 |
| 2021/0259430 | A1* | 8/2021 | Frankel | A47C 19/126 |
| 2022/0240684 | A1* | 8/2022 | Frankel | A47C 17/74 |

* cited by examiner

FOLDABLE BRACKET AND CAMPING BED

CROSS REFERENCE TO THE RELATED APPLICATIONS

This application is based upon and claims priority to Chinese Patent Application Nos. 2024112337113 and 2024221636336, both filed on Sep. 3, 2024, the entire contents of which are incorporated herein by reference.

TECHNICAL FIELD

The present invention relates to the field of bracket folding technology, and in particular, to a foldable bracket and a camping bed.

BACKGROUND

In the prior art, the design of foldable brackets often faces a common challenge: how to minimize the volume of a bracket in the folded state while ensuring the stable supporting performance of the bracket, especially to reduce the lateral space occupied.

Traditional foldable brackets mostly adopt linear or flat structures. Although these structures can be folded to a certain extent, they still occupy a large space in the folded state, which is not convenient to carry and store. Especially in outdoor adventures, trips, or daily use, users have higher requirements for the portability and folding efficiency of foldable brackets.

However, the existing design of foldable brackets can hardly meet the needs of stable support and convenient folding at the same time. On the one hand, a bracket generally has a complicated structure to ensure its supporting performance, resulting in a relatively large volume in the folded state; on the other hand, the volume of the bracket in the folded state may be reduced with compromise of the supporting stability of the bracket. Therefore, how to minimize the volume of a bracket in the folded state without compromising its supporting performance, especially to reduce the lateral space occupied, has become a technical problem that needs to be solved urgently.

SUMMARY

In view of the above problems, the present application provides a foldable bracket and a camping bed, to reduce the volume of the foldable bracket and the bed in a folded state.

To achieve the above objectives, the present application provides a foldable bracket, including:

a support post, where the support post includes: a retractable rod body, a first connecting member, and a second connecting member; the first connecting member and the second connecting member are respectively placed at two ends of the retractable rod body;

a support frame, where the support frame includes: a first support crossbar, a first support rod, and a second support rod; the first support crossbar is rotatably connected to the first connecting member;

the first support rod is rotatably connected to the second support rod, and one end of the first support rod is rotatably connected to the first connecting member; one end of the second support rod is rotatably connected to the second connecting member, and the other end of the second support rod is rotatably connected to the first support crossbar;

the second support rod includes: a first rod body and a second rod body; an end of the first rod body is rotatably connected to an end of the second rod body, the end of the first rod body away from the second rod body is rotatably connected to the first support crossbar, and the end of the second rod body away from the first rod body is rotatably connected to the second connecting member.

In the technical solution of the embodiment of the present application, the first connecting member includes: a first clamping plate, a second clamping plate, and a protrusion, the first clamping plate and the second clamping plate are arranged opposite to each other, a clamping channel is formed between the first clamping plate and the second clamping plate, the first clamping plate and the second clamping plate are connected to each other, and the protrusion is placed on the side of the first clamping plate away from the second clamping plate.

A first fixing groove is built in the protrusion, the first fixing groove is used to accommodate the retractable rod body, and the clamping channel is used to accommodate the first support crossbar and the first support rod.

In the technical solution of the embodiment of the present application, the second connecting member is provided with a second fixing groove and a through groove, the second fixing groove is adapted to the bottom of the retractable rod body, and the bottom of the retractable rod body is fixedly arranged in the second fixing groove; the clamping channel is used to accommodate the second support rod.

In the technical solution of the embodiment of the present application, an obtuse angle is formed between the first rod body and the second rod body, which faces toward the first connecting member.

In the technical solution of the embodiment of the present application, the support frame further includes: a second support crossbar, a third support rod, and a fourth support rod;

the second support crossbar is rotatably connected to the end of the first support crossbar away from the first connecting member through a third connecting member;

the third support rod and the fourth support rod are rotatably connected; one end of the third support rod is connected to the second support crossbar, and the other end is connected to the end of the first support rod away from the first connecting member through a fourth connecting member;

when the retractable rod body is pulled, the first support crossbar and the second support crossbar are folded.

In the technical solution of the embodiment of the present application, the third support rod and the fourth support rod form an X shape, and the end of the fourth support rod away from the ground is higher than the end of the second support crossbar or the fourth support rod away from the ground or flush with the second support crossbar.

In the technical solution of the embodiment of the present application, the third connecting member includes: a first connecting rod and a second connecting rod, one end of the first connecting rod has a first abutting surface, one end of the second connecting rod has a second abutting surface, and the upper part of the first abutting surface is hinged to the upper part of the second abutting surface.

The first support crossbar is connected to the first connecting rod, and the second support crossbar is connected to the second connecting rod.

In the technical solution of the embodiment of the present application, the fourth connecting member includes: a foot pad, a third clamping plate, and a fourth clamping plate; two ends of the third clamping plate are rotatably connected to the foot pad and the first support rod, respectively; two ends of the fourth clamping plate are rotatably connected to the foot pad and the third support rod, respectively.

In the technical solution of the embodiment of the present application, the support frame is symmetrically arranged on both sides of the support post.

The retractable rod body includes: an outer tube, an inner tube, and a first elastic member, the outer tube is sleeved on the inner tube, the inner tube and the outer tube are arranged to move relative to each other, two ends of the first elastic member are respectively placed on the side of the inner tube away from the end of the outer tube and the side of the outer tube away from the end of the inner tube, and the first elastic member is used to reset the retractable rod body.

When the inner tube extends out of the outer tube, the first elastic member is in a stretched state.

In the technical solution of the embodiment of the present application, the first elastic member is a spring, a rubber band, a gas cylinder, or a hydraulic rod.

In the technical solution of the embodiment of the present application, the support post also includes: a handle, and the handle is arranged on the first connecting member.

In the technical solution of the embodiment of the present application, the support post further includes: a storage platform.

The storage platform is placed on the first connecting member, a plurality of through holes is provided on the storage platform, and the through holes are used to accommodate objects.

To achieve the above objectives, the present application provides a camping bed, including: the foldable bracket described in any embodiment and a connecting frame;

- two foldable brackets are included, the two foldable brackets are symmetrically arranged, the connecting frame is placed between the two foldable brackets, and two ends of the connecting frame are respectively connected to one foldable bracket;
- when folding, the connecting frame is retracted to reduce the distance between the two foldable brackets.

In the technical solution of the embodiment of the present application, the connecting frame is a foldable support or a retractable support.

Different from the prior art, the above technical solution enables, by setting the retractable rod body, the first support crossbar, the first support rod, and the second support rod to rotate toward the retractable rod body when the foldable bracket is folded, which makes full use of the vertical space of the foldable bracket and thereby reduces the occupation of the lateral space; at the same time, the second support rod, the first support crossbar, and the retractable rod body are staggered, so that the second support rod, the first support crossbar, and the retractable rod body can overlap, avoiding mutual restriction, and thus reducing the volume of the foldable bracket in the second state.

The above description is only a summary of the technical solutions of the present application. In order to more clearly understand the technical means of the present application, allow the implementation in accordance with the contents of the specification, and make the above and other purposes, features, and advantages of the present application more apparent and easy to understand, the specific embodiments of the present application are listed below.

BRIEF DESCRIPTION OF THE DRAWINGS

By reading the detailed description of the preferred embodiments below, various other advantages and benefits will become clear to a person of ordinary skill in the art. The accompanying drawings are only for the purpose of illustrating the preferred embodiments and are not considered to limit the present application. Moreover, in all the drawings, the same element is designated with the same reference numeral. In the drawings.

ILLUSTRATION OF REFERENCE NUMERALS

Figure 1:
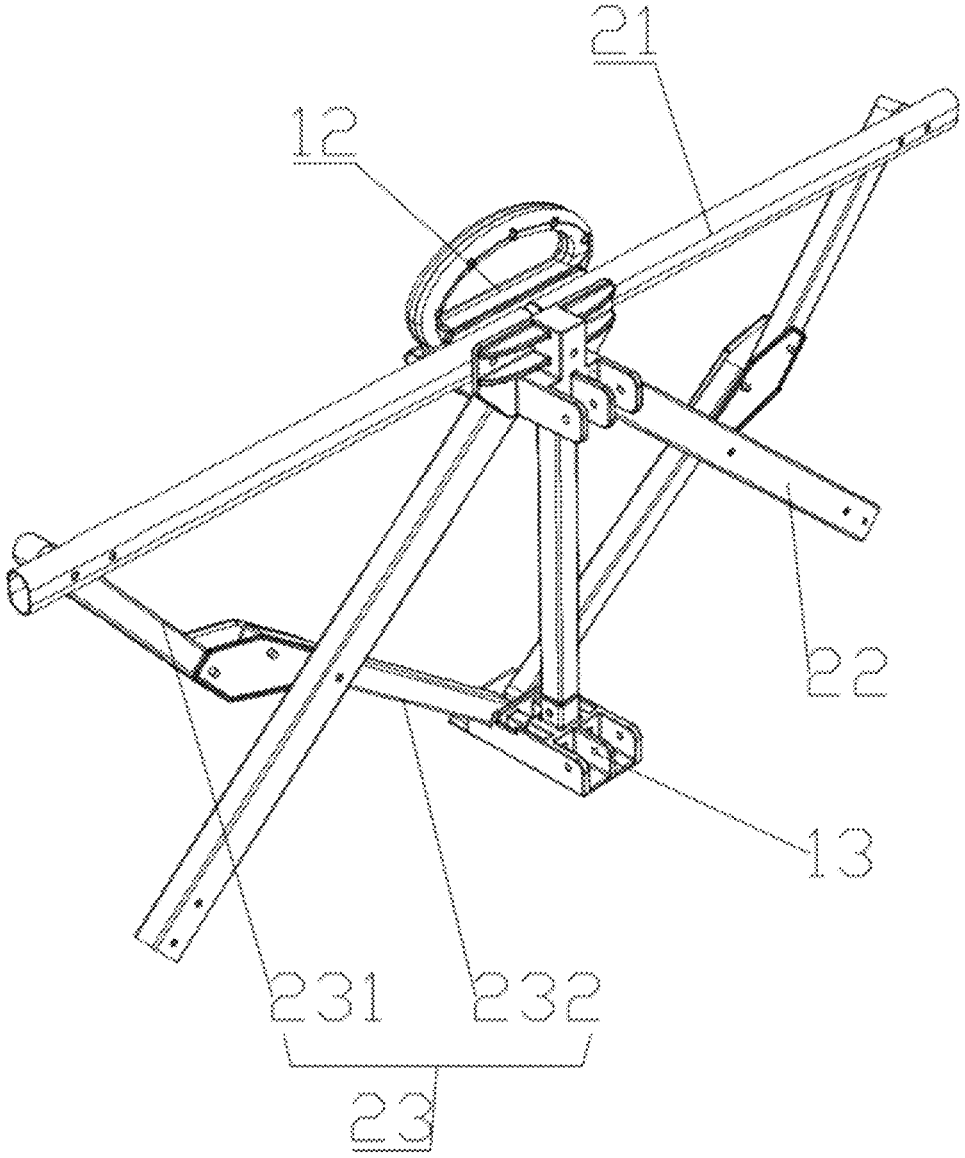
FIG. 1 is a structural diagram showing a first support crossbar, a first support rod, and a second support rod according to a specific embodiment.

10, support post; 20, support frame; 30, connecting frame; 11, retractable rod body; 12, first connecting member; 13, second connecting member; 14, handle; 15, storage platform;

21, first support crossbar; 22, first support rod; 23, second support rod; 24, second support crossbar; 25, third support rod; 26, fourth support rod; 27, third connecting member; 28, fourth connecting member;

31, first folding rod; 32, second folding rod; 33, elastic unit;

111, outer tube; 112, inner tube;

121, first clamping plate; 122, second clamping plate; 123, protrusion; 124, clamping channel; 125, first fixing groove;

131, second fixing groove; 132, through groove;

151, through hole;

231, first rod body; 232, second rod body;

271, first connecting rod; 272, second connecting rod; 273, guard plate;

281, foot pad; 282, third clamping plate; 283, fourth clamping plate.

DETAILED DESCRIPTION OF THE EMBODIMENTS

The embodiments of the technical solutions of the present application will be described in detail in conjunction with the accompanying drawings. The following embodiments are only used to more clearly illustrate the technical solutions of the present application, and are therefore only used as examples, and cannot be used to limit the scope of protection of the present application.

Referring to FIG. 1 to FIG. 10, the present embodiment discloses a foldable bracket, including:

a support post 10, where the support post 10 includes: a retractable rod body 11, a first connecting member 12, and a second connecting member 13; the first connecting member 12 and the second connecting member 13 are respectively placed at two ends of the retractable rod body 11;

a support frame 20, where the support frame 20 includes: a first support crossbar 21, a first support rod 22, and a second support rod 23; the first support crossbar 21 is rotatably connected to the first connecting member 12;

the first support rod 22 is rotatably connected to the second support rod 23, and one end of the first support rod 22 is rotatably connected to the first connecting member 12; one end of the second support rod 23 is rotatably connected to the second connecting member 13, and the other end of the second support rod 23 is rotatably connected to the first support crossbar 21;

the second support rod 23 includes: a first rod body 231 and a second rod body 232; an end of the first rod body 231 is rotatably connected to an end of the second rod body 232, the end of the first rod body 231 away from the second rod body 232 is rotatably connected to the first support crossbar 21, and the end of the second rod body 232 away from the first rod body 231 is rotatably connected to the second connecting member 13.

The retractable rod body 11 is arranged vertically, and the retractable rod body 11 can be restored when the foldable bracket is unfolded, that is, in a first state, and be extended when the foldable bracket is folded, that is, in a second state. The first connecting member 12 is placed at the top of the retractable rod body 11; specifically, referring to FIG. 6, the first connecting member 12 includes: a first clamping plate 121, a second clamping plate 122, and a protrusion 123, the first clamping plate 121 and the second clamping plate 122 are arranged opposite to each other, a clamping channel 124 is formed between the first clamping plate 121 and the second clamping plate 122, and the first clamping plate 121 and the second clamping plate 122 are connected to each other. The protrusion 123 is placed on the side of the first clamping plate 121 away from the second clamping plate 122.

A first fixing groove 125 is built in the protrusion 123, the first fixing groove 125 is adapted to the top of the retractable rod body 11, and the top of the retractable rod body 11 is fixed in the first fixing groove 125.

Figure 5:
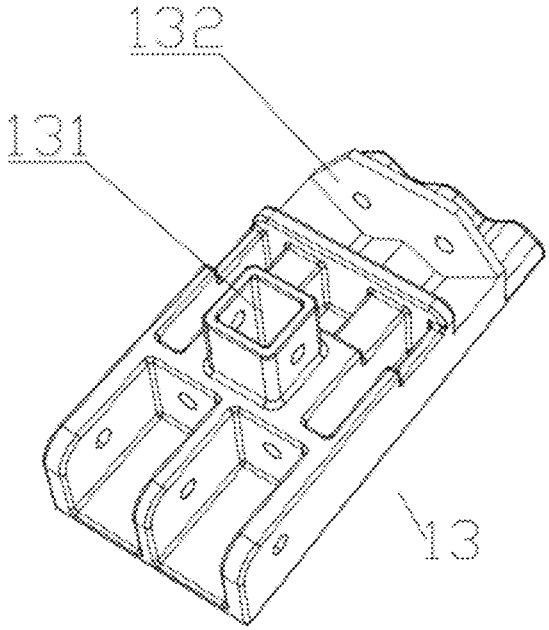
FIG. 5 is a structural diagram of a second connecting member according to a specific embodiment.

Referring to FIG. 5, the second connecting member 13 is placed at the bottom of the retractable rod body 11, the second connecting member 13 is provided with a second fixing groove 131 and a through groove 132, the second fixing groove 131 is adapted to the bottom of the retractable rod body 11, and the bottom of the retractable rod body 11 is fixedly arranged in the second fixing groove 131. Furthermore, the distance between the through groove 132 and the second fixing groove 131 fits the clamping channel 124.

The first support crossbar 21 is rotatably connected to the first connecting member 12; specifically, the top of the first support crossbar 21 is placed between the first clamping plate 121 and the second clamping plate 122, and the top of the first support crossbar 21 is rotatably connected to the first clamping plate 121 and/or the second clamping plate 122; when the retractable rod body 11 is in the first state, the first support crossbar 21 is horizontally arranged, and when the retractable rod body 11 switches from the first state to the second state, the first support crossbar 21 rotates toward the retractable rod body 11.

The first support rod 22 and the second support rod 23 are rotatably connected, and the first support rod 22 and the second support rod 23 form an X shape. Preferably, the middle part of the first support rod 22 is rotatably connected to the middle part of the second support rod 23. One end of the first support rod 22 is placed between the first clamping plate 121 and the second clamping plate 122, and the end of the first support rod 22 is rotatably connected to the first clamping plate 121 and/or the second clamping plate 122.

One end of the second support rod 23 is rotatably connected to the inner wall of the through groove 132.

An obtuse angle is formed between the first rod body 231 and the second rod body 232, which faces toward the first connecting member 12, so that the first rod body 231 can be sufficiently supported when the foldable bracket is in the first state; when the end of the first support crossbar 21 away from the first connecting member 12 is pressed down, the first rod body 231 and the second rod body 232 can be folded in a direction opposite to the direction faced by the obtuse angle, so that the first support crossbar 21 can continue to rotate downward. Specifically, the first rod body 231 and the second rod body 232 are connected by a fifth connecting member, the end of the first rod body 231 close to the second rod body 232 is rotatably connected to the fifth connecting member, and the end of the second rod body 232 close to the first rod body 231 is rotatably connected to the fifth connecting member; there is a gap between the first rod body 231 and the second rod body 232, and extension lines of the first rod body 231 and the second rod body 232 intersect to form the obtuse angle.

When the first support rod 22 is a vertical rod, the retractable rod body 11 needs to be extended to have a relatively large height, so that the first support crossbar 21 and the first support rod 22 form a straight line or approach a straight line in the second state.

The fifth connecting member includes two fifth clamping plates arranged opposite to each other, and the first rod body 231 and the second rod body 232 are placed between the two fifth clamping plates.

Different from the prior art, the above technical solution enables, by setting the retractable rod body 11, the first support crossbar 21, the first support rod 22, and the second support rod 23 to rotate toward the retractable rod body 11 when the foldable bracket is folded, which makes full use of the vertical space of the foldable bracket and thereby reduces the occupation of the lateral space; at the same time, the second support rod 23, the first support crossbar 21, and the retractable rod body 11 are staggered, so that the second support rod 23, the first support crossbar 21, and the retractable rod body 11 can overlap, avoiding mutual restriction, and thus reducing the volume of the foldable bracket in the second state.

Figure 2:
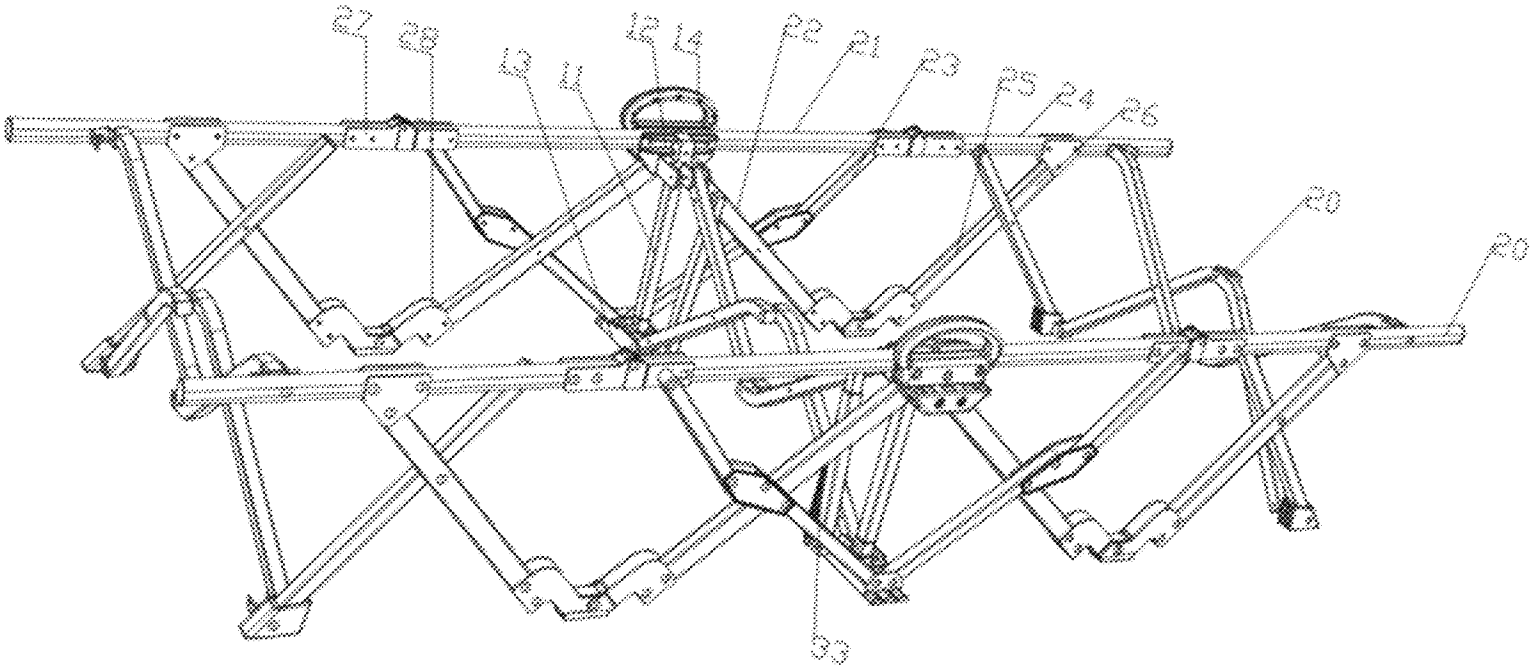
FIG. 2 is a structural diagram of a camping bed according to a specific embodiment.
Figure 3:
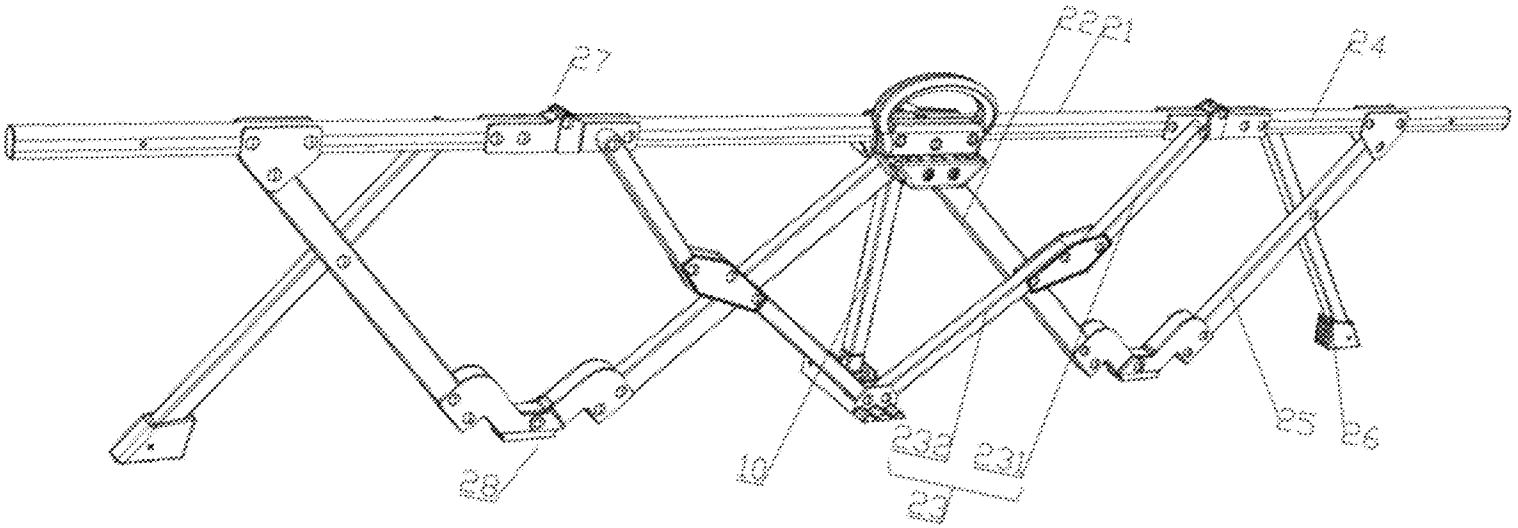
FIG. 3 is a structural diagram of a support frame according to a specific embodiment.

According to some embodiments of the present application, referring to FIG. 2 to FIG. 3, the support frame 20 further includes: a second support crossbar 24, a third support rod 25, and a fourth support rod 26;

the second support crossbar 24 is rotatably connected to the end of the first support crossbar 21 away from the first connecting member 12;

the third support rod 25 and the fourth support rod 26 are rotatably connected; one end of the third support rod 25 is connected to the second support crossbar 24, and the other end is connected to the end of the first support rod 22 away from the first connecting member 12;

when the retractable rod body 11 is pulled, the first support crossbar 21 and the second support crossbar 24 are folded.

The second support crossbar 24 is rotatably connected to the first support crossbar 21 through a third connecting member 27. Specifically, referring to FIG. 9, the third connecting member 27 includes: a first connecting rod 271 and a second connecting rod 272. One end of the first connecting rod 271 has a first abutting surface, and one end of the second connecting rod 272 has a second abutting surface. In the first state, the first abutting surface contacts the second abutting surface; the upper part of the first abutting surface is hinged to the upper part of the second abutting surface.

The end of the first support crossbar 21 close to the second support crossbar 24 is sleeved on the first connecting rod 271, and the end of the second support crossbar 24 close to the first support crossbar 21 is sleeved on the second connecting rod 272.

The third connecting member 27 also includes: guard plates 273, the guard plates 273 are placed on both sides of the first support crossbar 21 close to the second support crossbar 24, the guard plates 273 are placed on both sides of the second support crossbar 24 close to the first support crossbar 21, and the guard plates 273 on the first support crossbar 21 are rotatably connected to the guard plates 273 on the second support crossbar 24; that is, the guard plates 273 on the first support crossbar 21 move synchronously with the first connecting rod 271, and the guard plates 273 on the second support crossbar 24 move synchronously with the second connecting rod 272.

When the foldable bracket switches from the first state to the second state, the side of the first support crossbar 21 close to the second support crossbar 24 rotates away from the junction between the first connecting rod 271 and the second connecting rod 272, that is, rotates downward; the second support crossbar 24 rotates in the same way; such that the first support crossbar 21 and the second support crossbar 24 are folded.

The third support rod 25 and the fourth support rod 26 are rotatably connected, and the third support rod 25 and the fourth support rod 26 form an X shape. Preferably, the middle part of the third support rod 25 is rotatably connected to the middle part of the fourth support rod 26. Further, one end of the third support rod 25 is rotatably connected to the second support crossbar 24, and the other end of the third support rod 25 is rotatably connected to the first support rod 22.

Further, one end of the fourth support rod 26 is in contact with the ground to support the foldable bracket; the other end is flush with or higher than the upper surface of the second support crossbar 24 in the first state. Since the fabric is connected to the first support crossbar 21 and the second support crossbar 24, in the second state, the end of the fourth support rod 26 away from the ground can be used to support the fabric.

Figure 10:
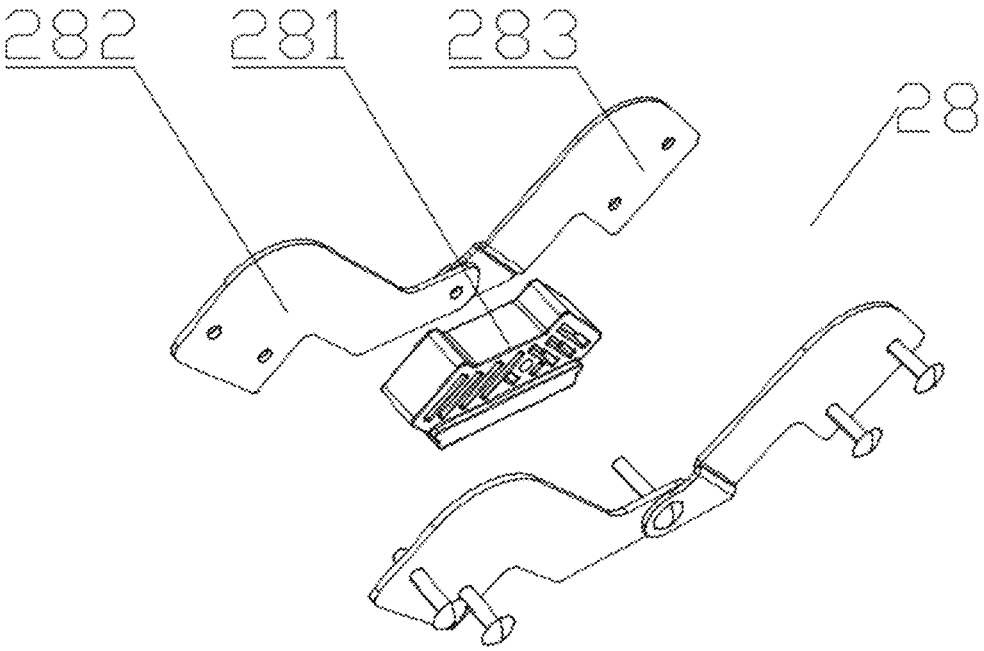
FIG. 10 is a structural diagram of a fourth connecting member according to a specific embodiment.

It should also be noted that, referring to FIG. 10, a fourth connecting member 28 is further included, the third support rod 25 is connected to the first support rod 22 through the fourth connecting member 28; specifically, the fourth connecting member 28 includes: a foot pad 281, a third clamping plate 282, and a fourth clamping plate 283; each of the third clamping plate 282 and the fourth clamping plate 283 is L-shaped, and two ends of the third clamping plate 282 are rotatably connected to the foot pad 281 and the first support rod 22, respectively; specifically, two third clamping plates 282 are included, and the two third clamping plates 282 are arranged opposite to each other. The end of the first support rod 22 away from the first connecting member 12 is placed between the two third clamping plates 282, and the rotating shaft sequentially passes through one third clamping plate 282, the first support rod 22, and the other third clamping plate 282; two fourth clamping plates 283 are included, the two fourth clamping plates 283 are arranged opposite to each other, the end of the third support rod 25 away from the second support crossbar 24 is placed between the two fourth clamping plates 283, and the rotating shaft sequentially passes through one fourth clamping plate 283, the third support rod 25, and the other fourth clamping plate 283. The foot pad 281 is used to support the foldable bracket on the ground, and two ends of the foot pad 281 are respectively placed between the two third clamping plates 282 and between the two fourth clamping plates 283.

During operation, when the support post 10 switches from the first state to the second state, the end of the first support crossbar 21 connected to the first connecting member 12 moves upward, and meanwhile, the end of the first support rod 22 close to the first connecting member 12 moves upward synchronously; so that the first support crossbar 21 and the other end of the first support rod 22 rotate toward the support post 10.

While the first support crossbar 21 rotates, the first support crossbar 21 presses down the second support crossbar 24, so that the first support crossbar 21 and the second support crossbar 24 are folded until the first support crossbar 21 and the second support crossbar 24 are in contact with each other; at the same time, the first support crossbar 21 drives the first rod body 231 to rotate downward, so that the first rod body 231 and the second rod body 232 are folded.

During the folding process of the second support crossbar 24 and the first support crossbar 21, the second support crossbar 24 drives the third support rod 25 to rotate toward the first support rod 22.

According to some embodiments of the present application, referring to FIG. 3, the support frame 20 is symmetrically arranged on both sides of the support post 10. The two support frames 20 are connected to the support post 10 in the same manner, which will not be repeated here. It should be noted that when the retractable rod body 11 is switched from the first state to the second state (the retractable rod body 11 is extended), the support frames 20 on both sides of the support post 10 are folded at the same time.

Figure 7:
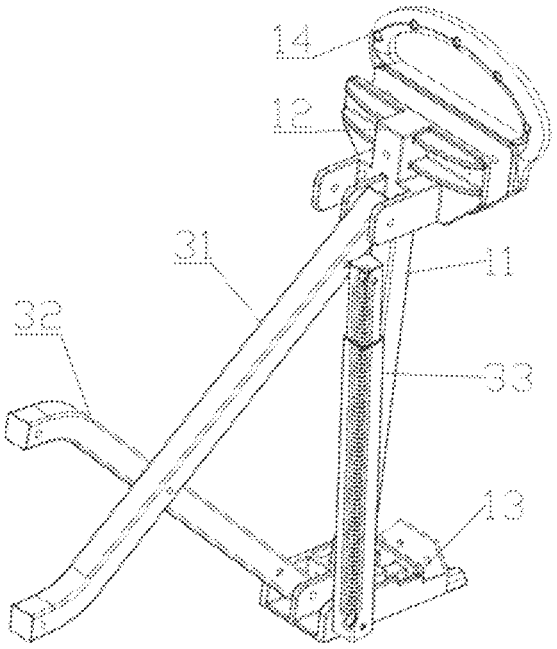
FIG. 7 is a structural diagram of a second elastic member according to a specific embodiment.
Figure 11:
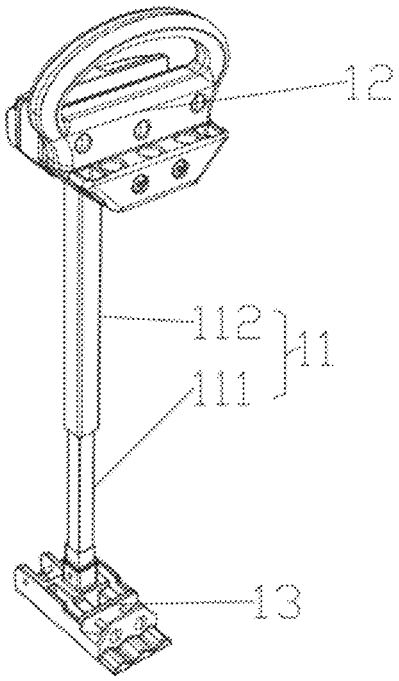
FIG. 11 is a structural diagram of a retractable rod body according to a specific embodiment.

According to some embodiments of the present application, referring to FIG. 7 and FIG. 11, the retractable rod body 11 includes: an outer tube 111, an inner tube 112, and a first elastic member, the outer tube 111 is sleeved on the inner tube 112, the inner tube 112 and the outer tube 111 are arranged to move relative to each other, two ends of the first elastic member are respectively placed on the side of the inner tube away from the end of the outer tube and the side of the outer tube away from the end of the inner tube, and the first elastic member is used to reset the retractable rod body.

When the inner tube extends out of the outer tube, the first elastic member is in a stretched state.

When the inner tube 112 extends out of the outer tube 111, the first elastic member is in a stretched state. The first elastic member is a spring, a rubber band, a gas cylinder, or a hydraulic rod.

The outer tube 111 is slidably sleeved on the inner tube 112, the outer tube 111 is connected to the first connecting member 12, and the inner tube 112 is connected to the second connecting member 13, that is, the top of the outer tube 111 is adapted to the first fixing groove 125, the outer tube 111 is fixed in the first fixing groove 125 of the first connecting member 12, the bottom of the inner tube 112 is adapted to the second fixing groove 131, and the inner tube 112 is fixed in the second fixing groove 131 of the second connecting member 13.

The first elastic member is an elastic object such as a spring or a rubber band, two ends of the first elastic member are respectively connected to the inner tube 112 and the outer tube 111, and the two ends of the first elastic member are respectively connected to the end of the outer tube 111 away from the inner tube 112 and the end of the inner tube 112 away from the outer tube 111. In some other embodiments, one end of the first elastic member is connected to the outer tube 111 and the other end is connected to the second connecting member 13, or one end of the first elastic member is connected to the inner tube 112 and the other end is connected to the first connecting member 12.

When the inner tube 112 extends out of the outer tube 111, the foldable bracket is in the second state, and the first elastic member is in a stretched state to store elastic force; when the foldable bracket needs to be unfolded, a user only needs to slightly press the retractable rod body 11, and the inner tube 112 and the outer tube 111 will move toward each other under the action of elastic force. The arrangement of the first elastic member allows the foldable bracket to be automatically unfolded.

Figure 4:
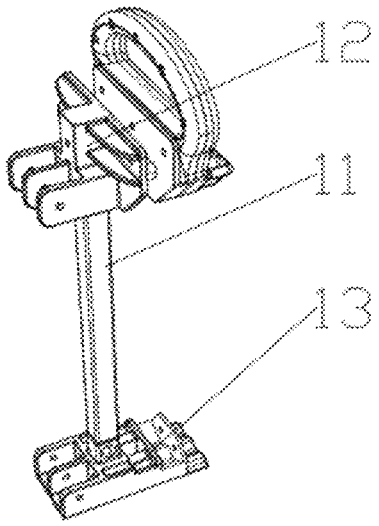
FIG. 4 is a structural diagram of a support post according to a specific embodiment.
Figure 6:
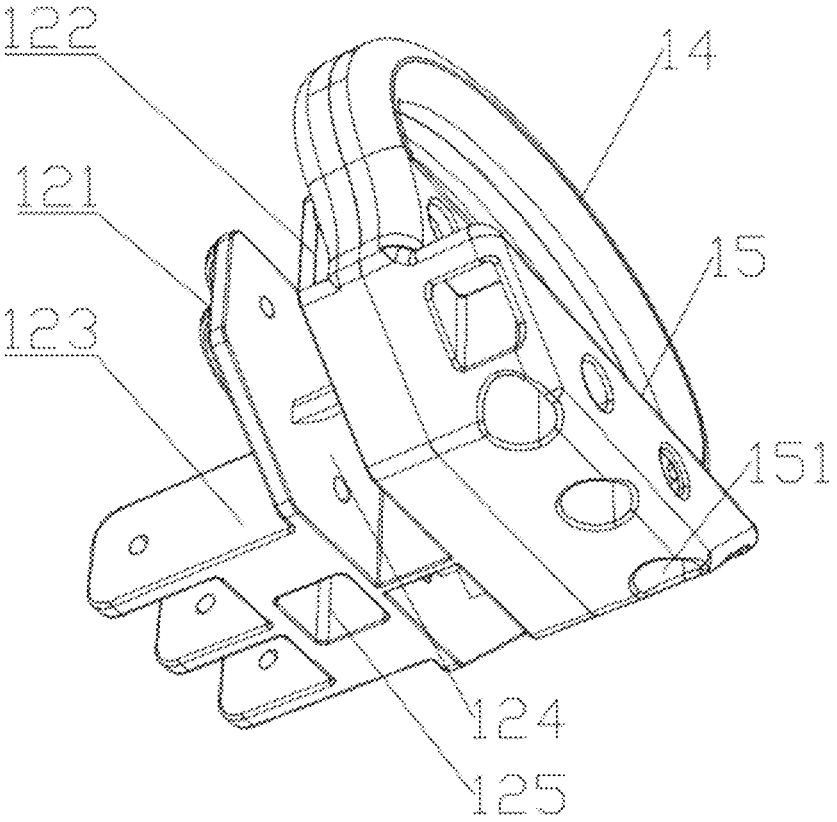
FIG. 6 is a structural diagram of a first connecting member according to a specific embodiment.

According to some embodiments of the present application, referring to FIG. 4, FIG. 6, and FIG. 7, the support post 10 also includes: a handle 14, and the handle 14 is arranged on the first connecting member 12.

The handle 14 is arranged on the support post 10 to facilitate the user to operate the foldable bracket; specifically, the handle 14 is a vertically arranged annular handle 14, and the handle 14 is arranged on the side of the second clamping plate 122 away from the first clamping plate 121.

According to some embodiments of the present application, referring to FIG. 4, FIG. 6, and FIG. 7, the support post 10 further includes: a storage platform 15.

The storage platform 15 is placed on the first connecting member 12, a plurality of through holes 151 is provided on the storage platform 15, and the through holes 151 are used to accommodate objects.

The storage platform 15 is placed on the support post 10, so that the user can hang objects on the foldable bracket; specifically, the storage platform 15 is a protrusion protruding from the support post 10, and the storage platform 15 is placed on the side of the second clamping plate 122 away from the first clamping plate 121. The storage platform 15 is provided with the through holes 151, each of the through holes 151 passes through the storage platform 15, and the through holes 151 are vertically provided on the storage platform 15 for hanging objects.

Referring to FIG. 1 to FIG. 11, the present embodiment provides a camping bed, including: the foldable bracket according to any of claims 1 to 8 and a connecting frame 30.

Two foldable brackets are included, the two foldable brackets are symmetrically arranged, the connecting frame is placed between the two foldable brackets, and two ends of the connecting frame 30 are respectively connected to one foldable bracket.

Folding process refers to a process of switching from the first state to the second state, that is, during the process of switching from the first state to the second state, the connecting frame located in the middle is retracted or folded to reduce the distance between the two foldable brackets, so that the camping bed is folded.

In some other embodiments, the camping bed also includes: a bed cloth; the length of the bed cloth fits the length of the foldable bracket in the first state, and the width of the bed cloth fits the length of the connecting frame unfolded; further, opposite sides of the bed cloth are sleeved on the first support crossbar 21 and the second support crossbar 24; the bed cloth can be folded accordingly when the foldable bracket is folded.

Figure 8:
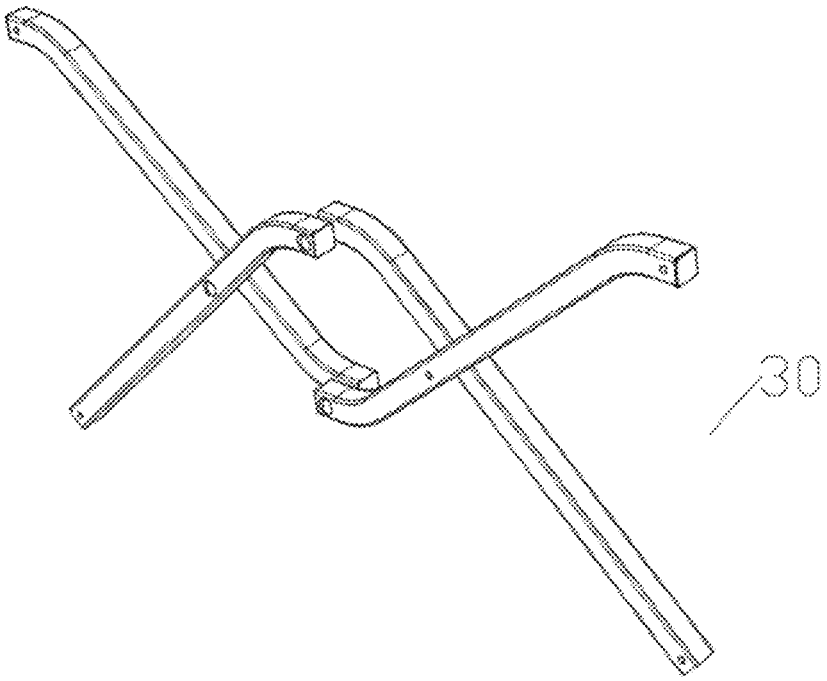
FIG. 8 is a structural diagram of a connecting frame according to a specific embodiment.
Figure 9:
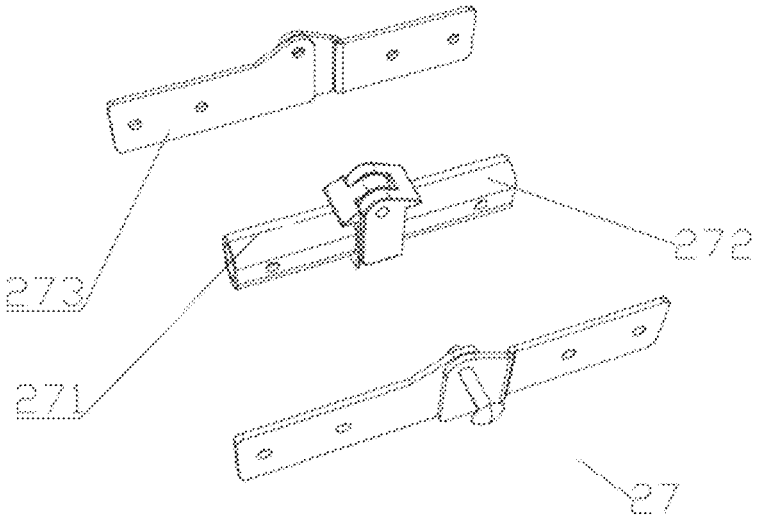
FIG. 9 is a structural diagram of a third connecting member according to a specific embodiment.

According to some embodiments of the present application, referring to FIG. 7 and FIG. 8, the connecting frame 30 is a foldable support or a retractable support.

In some embodiments, the retractable support is a retractable bar. When the foldable bracket is required to be folded, the retractable bar can be pressed to reduce the distance between the two foldable brackets arranged opposite to each other.

In some other embodiments, the foldable support includes: a first folding rod 31, a second folding rod 32, a third folding rod, and a fourth folding rod, where the first folding rod 31 and the second folding rod 32 are rotatably connected in the middle to form an X shape, and similarly, the third folding rod and the fourth folding rod are also rotatably connected in the middle to form an X shape; one end of the first folding rod 31 is rotatably connected to the foldable bracket, and the other end is rotatably connected to the fourth folding rod, and one end of the second folding rod 32 is rotatably connected to the foldable bracket, and the other end is rotatably connected to the third folding rod. Further, the first folding rod 31 and the third folding rod are in the same plane, and the second folding rod 32 and the fourth folding rod are in the same plane; when the foldable bracket is required to be folded, the first folding rod 31 and the third folding rod approach to each other, and the second folding rod 32 and the fourth folding rod approach to each other.

In some other embodiments, a camping bed reset mechanism includes: the foldable bracket, the first folding rod 31, the second folding rod 32, and an elastic unit 33.

The first folding rod 31 and the second folding rod 32 are rotatably connected, and the first folding rod 31 and the second folding rod 32 form an X shape, a Y shape or a V shape.

The first folding rod 31 and the first connecting member 12 are rotatably connected, and the second folding rod and the second connecting member are rotatably connected.

Two ends of the elastic unit 33 are respectively placed on one side of the first connecting member 12 and one side of the second connecting member 13, and the elastic unit 33 is used to reset the foldable bracket.

Specifically, the first folding rod 31 and the second folding rod 32 are rotatably connected to form an X shape, that is, the middle part of the first folding rod 31 and the middle part of the second folding rod 32 are rotatably connected. When folding, the first folding rod 31 and the second folding rod 32 move toward each other along the horizontal direction, and when unfolding, the first folding rod 31 and the second folding rod 32 move toward each other along the height direction.

One end of the elastic unit 33 is connected to the second connecting member 13, and the other end of the elastic unit 33 is connected to the first folding rod 31. When folding, the user pulls the first connecting member 12 upward to increase the height of the first folding rod 31, and meanwhile, the elastic unit 33 stores elastic force. When unfolding, the elastic unit 33 releases elastic force, and the end of the first folding rod 31 close to the foldable bracket is pulled down, so that the first folding rod 31 moves downward, and consequently, the foldable bracket is unfolded through linkage.

The elastic unit 33 includes: a second elastic member and a retractable member. One end of the retractable member is rotatably connected to the second connecting member 13, the other end of the retractable member is rotatably connected to the first folding rod, and two ends of the second elastic member are respectively connected to the two ends of the retractable member.

The retractable member includes tube bodies that are sleeved on each other, and the second elastic member is a spring, a rubber band, a gas cylinder, or a hydraulic rod. Preferably, the second elastic member is a spring.

Finally, it should be noted that the above embodiments are only used to illustrate the technical solutions of the present application, rather than to limit them; although the present application has been described in detail with reference to the aforementioned embodiments, those skilled in the art should understand that they can still modify the technical solutions described in the aforementioned embodiments, or equivalently replace some or all of the technical features therein; and these modifications or replacements do not make the essence of the corresponding technical solutions deviate from the scope of the technical solutions of the embodiments of the present application, instead, they should all be included in the scope of the claims and specification of the present application. In particular, as long as there is no structural conflict, the various technical features mentioned in the various embodiments can be combined in any way. The present application is not limited to the specific embodiments disclosed herein, but includes all technical solutions that fall within the scope of the claims.

What is claimed is:

1. A foldable bracket, comprising:

a support post, wherein the support post comprises: a retractable rod body, a first connecting member, and a second connecting member; the first connecting member and the second connecting member are respectively placed at two ends of the retractable rod body;

a support frame, wherein the support frame comprises: a first support crossbar, a second support crossbar, a first support rod, a second support rod, a third support rod, and a fourth support rod; the first support crossbar is rotatably connected to the first connecting member; the second support crossbar is rotatably connected to an end of the first support crossbar away from the first connecting member through a third connecting member; the third support rod and the fourth support rod are rotatably connected; one end of the third support rod is connected to the second support crossbar, and the other end is connected to an end of the first support rod away from the first connecting member through a fourth connecting member; when the retractable rod body is pulled, the first support crossbar and the second support crossbar are folded;

wherein the first support rod is rotatably connected to the second support rod, and one end of the first support rod is rotatably connected to the first connecting member; one end of the second support rod is rotatably connected to the second connecting member, and the other end of the second support rod is rotatably connected to the first support crossbar.

2. The foldable bracket according to claim 1, wherein the first connecting member comprises: a first clamping plate, a second clamping plate, and a protrusion, the first clamping plate and the second clamping plate are arranged opposite to each other, a clamping channel is formed between the first clamping plate and the second clamping plate, the first clamping plate and the second clamping plate are connected to each other, and the protrusion is placed on a side of the first clamping plate away from the second clamping plate;

a first fixing groove is built in the protrusion, the first fixing groove is used to accommodate the retractable rod body, and the clamping channel is used to accommodate the first support crossbar and the first support rod.

3. The foldable bracket according to claim 1, wherein the second connecting member is provided with a second fixing groove and a through groove, the second fixing groove is adapted to a bottom of the retractable rod body, and the bottom of the retractable rod body is fixedly arranged in the second fixing groove; the clamping channel is used to accommodate the second support rod.

4. The foldable bracket according to claim 1, wherein the second support rod comprises: a first rod body and a second rod body; an end of the first rod body is rotatably connected to an end of the second rod body, and an end of the first rod body away from the second rod body is rotatably connected to the first support crossbar, and an end of the second rod body away from the first rod body is rotatably connected to the second connecting member.

5. The foldable bracket according to claim 4, wherein an obtuse angle is formed between the first rod body and the second rod body and faces toward the first connecting member.

6. The foldable bracket according to claim 1, wherein the third support rod and the fourth support rod form an X shape, an end of the fourth support rod away from the ground is higher than an end of the second support crossbar or the fourth support rod away from the ground or flush with the second support crossbar.

7. The foldable bracket according to claim 1, wherein the third connecting member comprises: a first connecting rod and a second connecting rod, one end of the first connecting rod has a first abutting surface, one end of the second connecting rod has a second abutting surface, an upper part of the first abutting surface is hinged to an upper part of the second abutting surface;

the first support crossbar is connected to the first connecting rod, and the second support crossbar is connected to the second connecting rod.

8. The foldable bracket according to claim 1, wherein the fourth connecting member comprises: a foot pad, a third clamping plate, and a fourth clamping plate; two ends of the third clamping plate are rotatably connected to the foot pad and the first support rod, respectively; two ends of the fourth clamping plate are rotatably connected to the foot pad and the third support rod, respectively.

9. The foldable bracket according to claim 1, wherein the support frame is symmetrically arranged on both sides of the support post.

10. The foldable bracket according to claim 1, wherein the retractable rod body comprises: an outer tube, an inner tube, and a first elastic member, the outer tube is sleeved on the inner tube, the inner tube and the outer tube are arranged to move relative to each other, two ends of the first elastic member are respectively placed on a side of the inner tube away from an end of the outer tube and a side of the outer tube away from an end of the inner tube, and the first elastic member is used to reset the retractable rod body;

when the inner tube extends out of the outer tube, the first elastic member is in a stretched state.

11. The foldable bracket according to claim 10, wherein the first elastic member is a spring, a rubber band, a gas cylinder, or a hydraulic rod.

12. The foldable bracket according to claim 1, wherein the support post further comprises: a handle, and the handle is arranged on the first connecting member.

13. The foldable bracket according to claim 1, wherein the support post further comprises: a storage platform;

the storage platform is placed on the first connecting member, a plurality of through holes is provided on the storage platform, and the through holes are used to accommodate objects.

14. A camping bed, comprising: the foldable bracket according to claim 1 and a connecting frame; wherein two foldable brackets are included, the two foldable brackets are symmetrically arranged, the connecting frame is placed between the two foldable brackets, and two ends of the connecting frame are respectively connected to one foldable bracket;

when folding, the connecting frame is retracted to reduce a distance between the two foldable brackets.

15. The camping bed according to claim 14, wherein the connecting frame is a foldable support or a retractable support.

16. A camping bed reset mechanism, comprising: a foldable bracket, a first folding rod, a second folding rod, and an elastic unit; wherein the foldable bracket comprises:

a support post, wherein the support post comprises: a retractable rod body, a first connecting member, and a second connecting member; the first connecting member and the second connecting member are respectively placed at two ends of the retractable rod body;

a support frame, wherein the support frame comprises: a first support crossbar, a first support rod, and a second support rod; the first support crossbar is rotatably connected to the first connecting member;

wherein the first support rod is rotatably connected to the second support rod, and one end of the first support rod is rotatably connected to the first connecting member; one end of the second support rod is rotatably connected to the second connecting member, and the other end of the second support rod is rotatably connected to the first support crossbar;

the first folding rod and the second folding rod are rotatably connected, and the first folding rod and the second folding rod form an X shape, a Y shape or a V shape;

the first folding rod and the first connecting member are rotatably connected, and the second folding rod and the second connecting member are rotatably connected;

two ends of the elastic unit are respectively placed on one side of the first connecting member and one side of the second connecting member, and the elastic unit is used to reset the foldable bracket.

17. The camping bed reset mechanism according to claim 16, wherein the elastic unit comprises: a second elastic member and a retractable member, one end of the retractable member is rotatably connected to the second connecting member, the other end of the retractable member is rotatably connected to the first folding rod, and two ends of the second elastic member are respectively connected to two ends of the retractable member.

* * * * *